US007096845B1

(12) United States Patent
Vaandrager et al.

(10) Patent No.: US 7,096,845 B1
(45) Date of Patent: Aug. 29, 2006

(54) CAPTURED NUT USING A STAMPED RETENTION FEATURE

(75) Inventors: Gary J. Vaandrager, Livonia, MI (US); Richard K. Marsh, Shelby Township, MI (US); Robert J. Krokosky, Troy, MI (US); James B. Korsedal, Holly, MI (US); Mohammed M. Abuelroos, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 3 days.

(21) Appl. No.: 11/058,138

(22) Filed: Feb. 15, 2005

(51) Int. Cl.
*F01M 1/00* (2006.01)

(52) U.S. Cl. ..... 123/196 R; 123/195 A; 74/424.78; 411/999

(58) Field of Classification Search ..... 123/196 R, 123/195 A, 196 S; 74/841, 424.78; 411/372.5, 411/372.6, 373, 999, 547, 352, 353, 85, 134, 411/222, 431, 533
See application file for complete search history.

(56) References Cited

U.S. PATENT DOCUMENTS 3,782,437 A * 1/1974 Seckerson ..... 411/107
5,080,546 A * 1/1992 Purvin et al. ..... 411/156
5,190,423 A * 3/1993 Ewing ..... 411/134

* cited by examiner

*Primary Examiner*—Tony M. Argenbright
*Assistant Examiner*—Katrina B. Harris
(74) *Attorney, Agent, or Firm*—Christopher DeVries

(57) ABSTRACT

A bracket and nut assembly including a bracket having a first end and second end. The first end includes a first substantially planar portion spaced apart from and positioned substantially parallel to a second substantially planar portion. A third portion interconnects the first and second portions. A first aperture extends through the first portion and a second aperture extends through the second portion. The first and second apertures are axially aligned with one another. A nut includes a substantially cylindrical hollow body having flats, a first end and a second end. A flange radially extends from the first end. The flange is captured between the first portion and the second portion of the bracket such that the nut is operable to translate and rotate relative to the bracket.

20 Claims, 5 Drawing Sheets

CAPTURED NUT USING A STAMPED RETENTION FEATURE

FIELD OF THE INVENTION

The present invention relates to self-retained fasteners, and more particularly to a captured nut using a stamped retention feature.

BACKGROUND OF THE INVENTION

Threaded fasteners have been used to interconnect automotive components for years. Typically, a bolt having an externally threaded shaft is mated with a nut having an internally threaded aperture to provide a clamping force to members positioned between the bolt and the nut. During the assembly of complex machines such as automotive engines, the fasteners may be dropped or misplaced. Unfortunately, the dropped fastener may become trapped within an internal cavity of the engine and possibly cause significant damage. If multiple components must be handled and positioned during the fastener installation process, the likelihood of dropping the fastener increases. Accordingly, it may be desirable to attach a fastener, such as a nut, to a component that is to be mounted on the engine and thereby eliminate the risk of dropping the nut within the engine cavity. Furthermore, it may be desirable to provide a component and nut assembly having an axially translatable and rotatable nut that is captured by the component to allow mounting the component on an existing stud or bolt that extends from the engine.

SUMMARY OF THE INVENTION

The present invention provides a bracket and nut assembly including a bracket having a first end and second end. The first end includes a first substantially planar portion spaced apart from and positioned substantially parallel to a second substantially planar portion. A third portion interconnects the first and second portions. A first aperture extends through the first portion and a second aperture extends through the second portion. The first and second apertures are axially aligned with one another. A nut includes a substantially cylindrical hollow body having flats, a first end and a second end. A flange radially extends from the first end. The flange is captured between the first portion and the second portion of the bracket such that the nut is operable to translate and rotate relative to the bracket.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
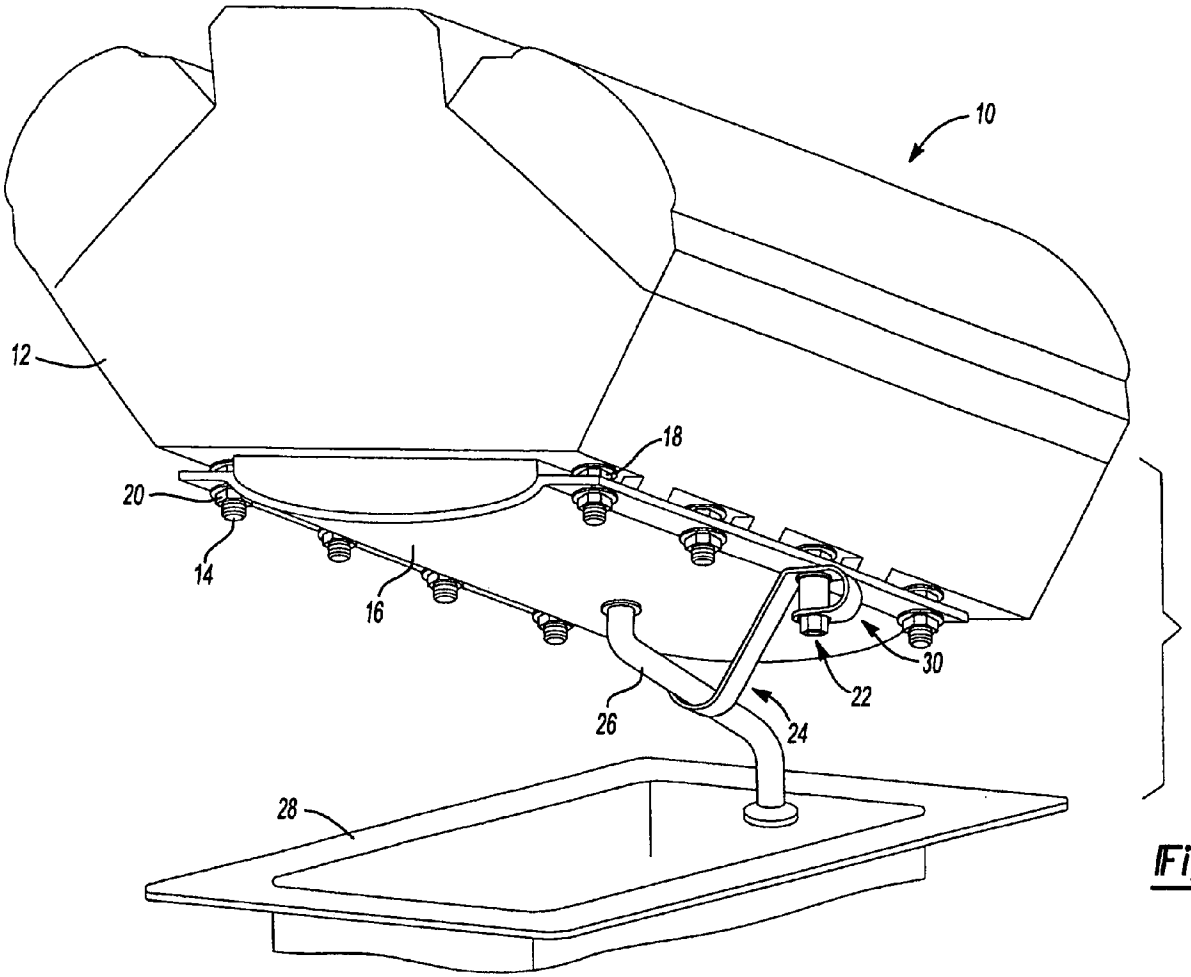
FIG. 1 is an exploded perspective view of an internal combustion engine constructed in accordance with the teachings of the present invention.

With reference to FIG. 1, an exemplary internal combustion engine 10 is constructed in accordance with the teachings of the present invention. The engine 10 includes a block 12, a plurality of studs 14 extending therefrom, a deflector 16, a first plurality of nuts 18, a second plurality of nuts 20, a captured nut 22, a bracket 24, an oil pickup tube 26 and an oil pan 28. The captured nut 22 and the bracket 24 comprise a bracket and captured nut assembly 30. The oil pickup tube 26 is coupled to an end of the bracket 24. The bracket 24 is fastened to a stud 14 extending from the block 12 through the use of the captured nut 22.

Figure 2:
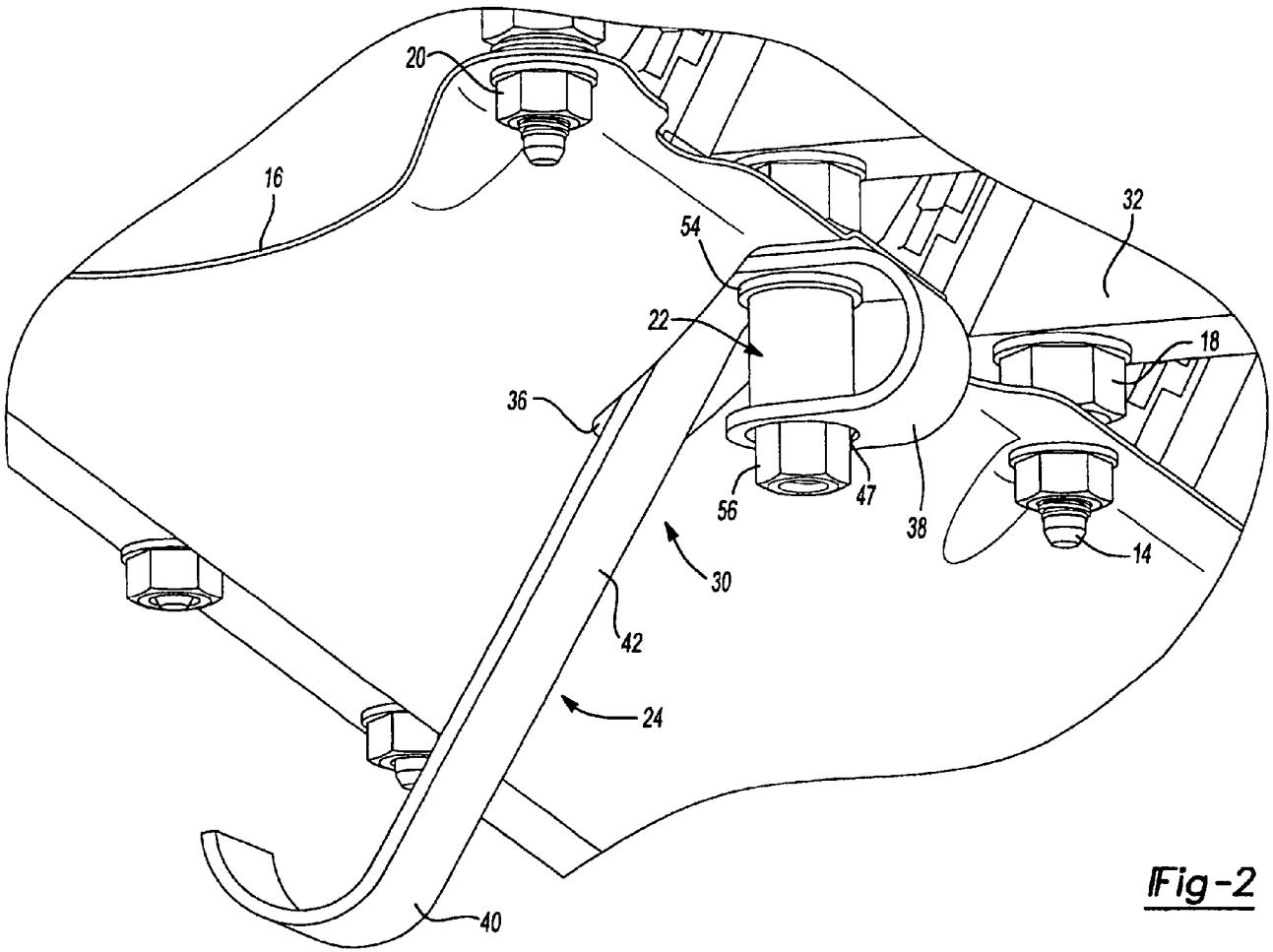
FIG. 2 is a more detailed perspective view of a bracket and nut assembly coupled to the internal combustion engine.
Figure 3:
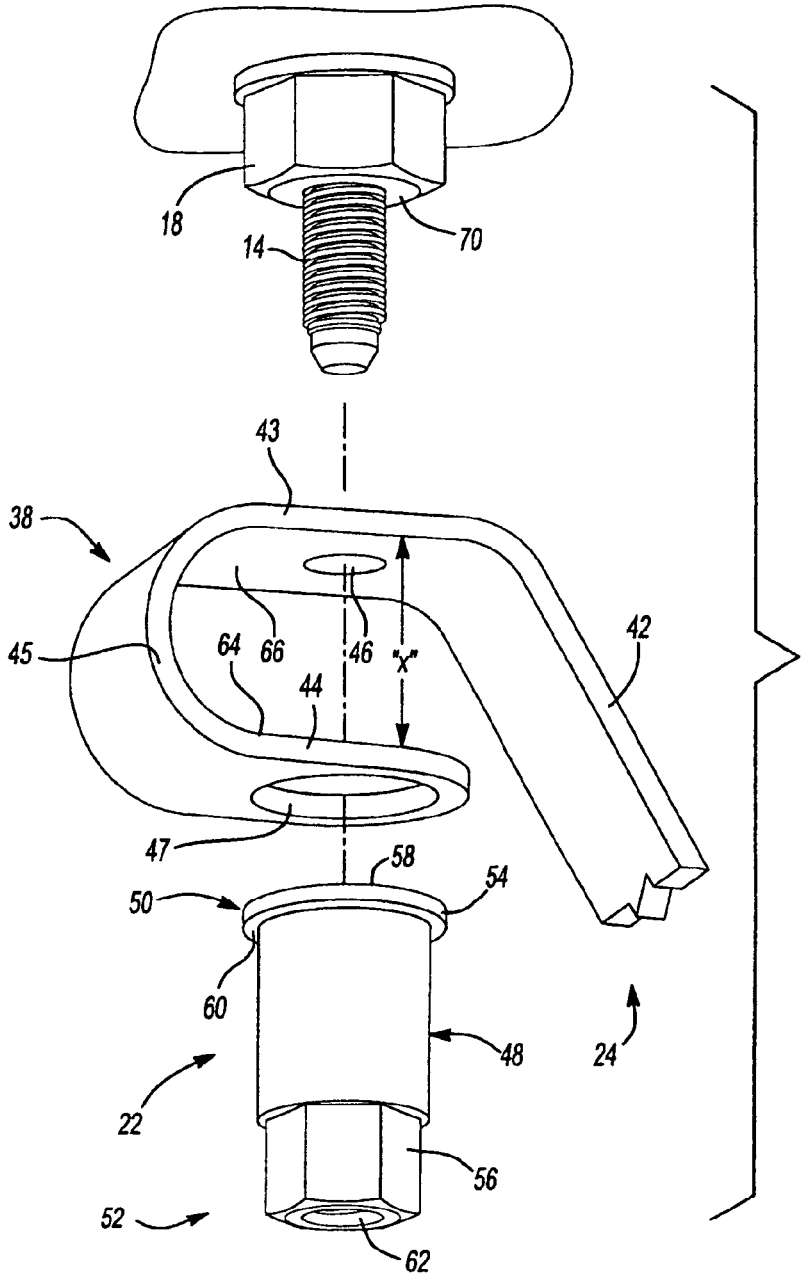
FIG. 3 is an exploded perspective view of the bracket and nut assembly.

FIG. 2 depicts the bracket and captured nut assembly 30 in greater detail. Studs 14 extend from bearing cap 32 of the engine 10. Nuts 18 are coupled to the studs 14 to secure the bearing cap 32 to the block 12. A deflector 16 is located below the nuts 18. The deflector 16 contains a series of apertures 34 to accept the studs 14. Nuts 20 are coupled to the studs 14 below the deflector 16 to fasten the deflector 16 to the bearing cap 32. At the location of attachment for the bracket and captured nut assembly 30, the deflector 16 contains a recess 36 to accommodate installation of the bracket and captured nut assembly 30. The recess 36 is generally "U-shaped" and provides clearance for the installation of the bracket and captured nut assembly 30.

FIGS. 2–5 depict the bracket and nut assembly 30 including the bracket 24 having a first portion 38, a second portion 40 and an intermediate portion 42. The first portion 38 generally comprises a "C-shape." The first portion 38 includes a first land 43, a second land 44 and a curved wall 45 interconnecting the first land 43 and the second land 44. Both first land 43 and second land 44 are substantially planar and spaced apart from one another a distance X. An aperture 46 extends through first land 43. An aperture 47 extends through second land 44. The captured nut 22 is used to fasten the bracket 24 to the engine 10. The intermediate portion 42 is substantially planar and extends at an angle from the first land 43 and passes through the recess 36 formed in the deflector 16. The intermediate portion 42 positions the second portion 40 at a location useful for supporting oil pickup tube 26. The second portion 40 is substantially "U-shaped" and adapted to be coupled to the oil pickup tube 26.

The captured nut 22 includes a substantially cylindrical body 48 having a first end 50 and a second end 52. A flange 54 radially extends from the first end 50. Flats 56 are formed in the shape of a hexagon at the second end 52 to provide means for applying torque to captured nut 22. Alternatively, flats 56 may extend along the entire length of nut 22. The flange 54 extending from the nut 22 includes a first surface 58 and a second surface 60. The nut 22 has an internally threaded aperture 62 extending axially through its center.

Figure 4:
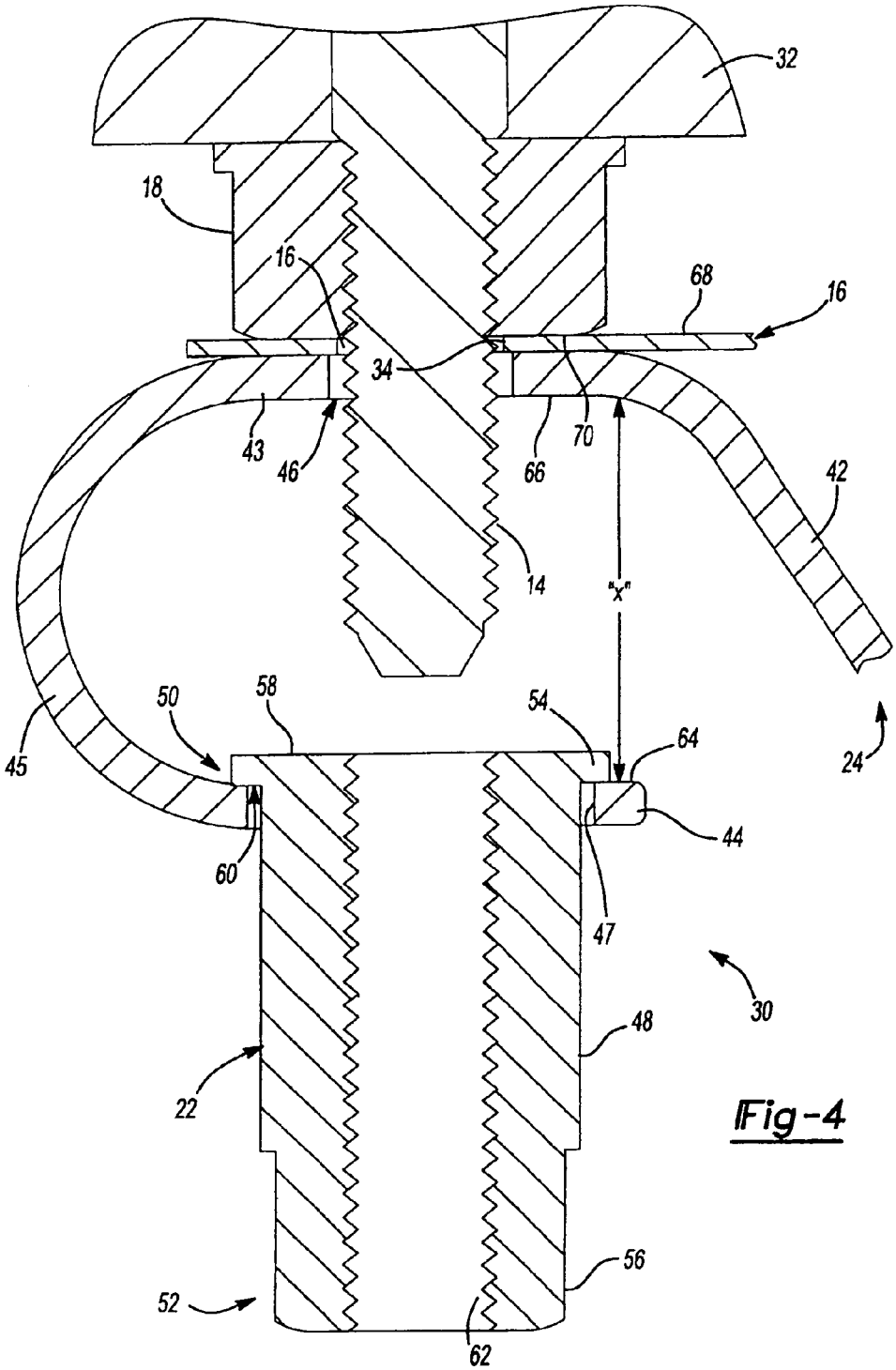
FIG. 4 is a sectional view of the bracket and nut assembly with the nut shown disengaged from a stud.
Figure 5:
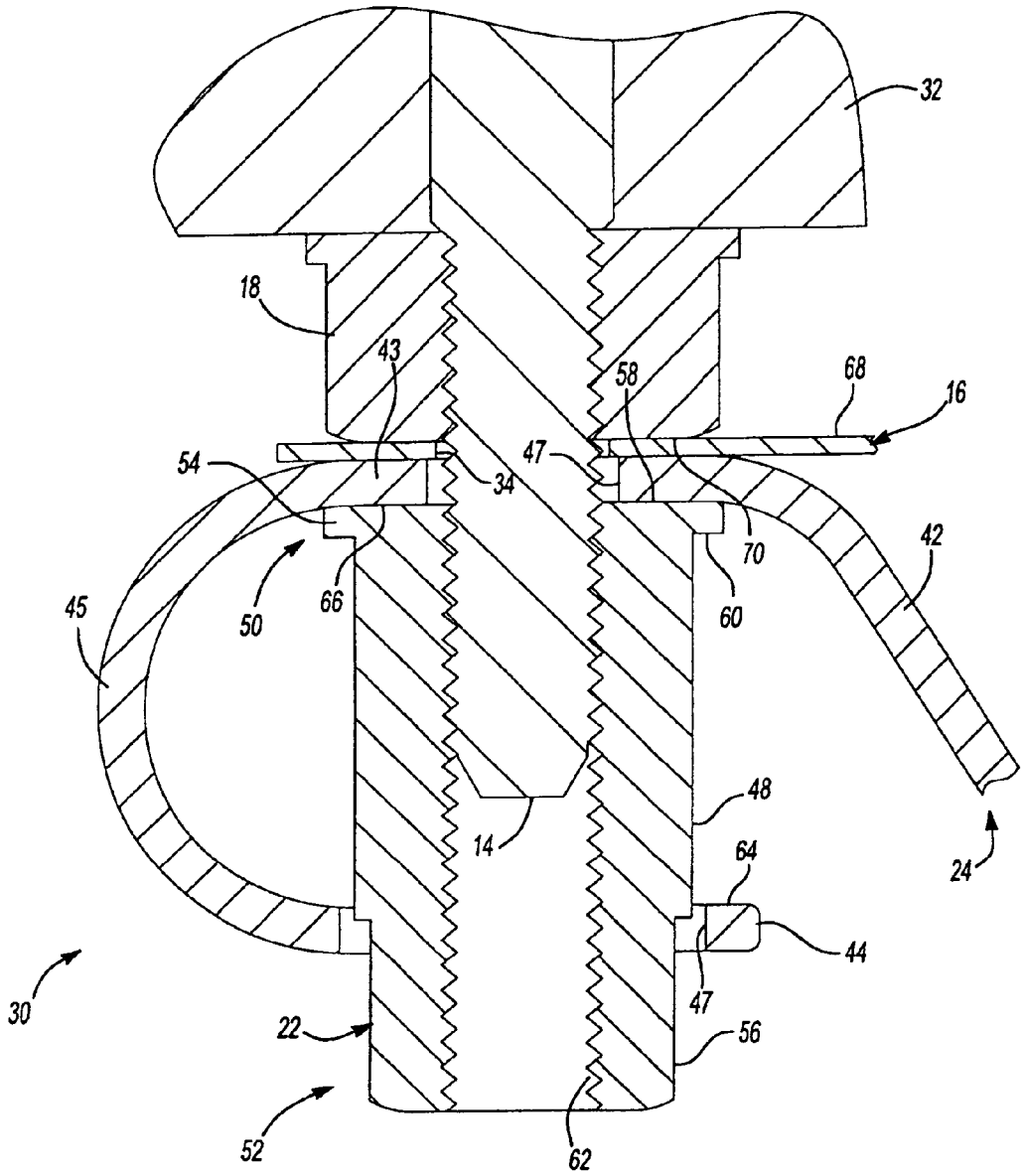
FIG. 5 is a sectional view of the bracket and nut assembly with the nut shown engaged with a stud.

As best shown in FIGS. 4 and 5, the aperture 47 extending through bracket 24 is sized to retain a portion of the captured nut 22. Specifically, the aperture 47 has a diameter that is greater than the outer diameter of the body 48 of the nut 22. However, the aperture 47 has a diameter less than the outer diameter of the flange 54. Accordingly, body 48 is initially inserted through aperture 47 into the assembly 30 before the "C-shape" of the first portion 38 is formed. Once the "C-shape" is formed, it allows for axial translation of the nut 22 within the aperture 47, but provides for retention of the nut 22 within the bracket 24. This goal is achieved by limiting the range of motion of nut 22 between a first position shown in FIG. 4 and a second position shown in FIG. 5. The second surface 60 of the flange 54 engages a surface 64 of the second land 44 when nut 22 is in the first position. The first surface 58 of the flange engages a surface 66 of the first land 43 when the nut 22 is in the second position.

The spacing "X" between the first land 43 and the second land 44 is less than the overall length of nut 22. As such, the nut 22 is captured within the aperture 47 between the first land 43 and the second land 44. The aperture 46 extending through the first land 43 of the bracket 24 has a diameter less than the diameter of the flange 54. The surface 66 surrounding the aperture 46 is in engagement with the first surface 58 to prevent the captured nut 22 from axially translating past the second position. The diameter of the aperture 46 is sized to allow the threaded portion of the stud 14 to pass therethrough. However, the diameter of the aperture 46 is less than the diameter of the first nut 18 to allow nut 22 to provide a clamping force on bracket 24. Aperture 46 is coaxially aligned with aperture 47 to allow threaded connection of nut 22 and stud 14.

The process of coupling the bracket and captured nut assembly 30 to engine 10 is described below. The first nut 18 is engaged with the stud 14 to secure the bearing cap 32 to the engine block 12. The deflector 16 is positioned to abut the first nut 18 by engaging a first side 68 of the deflector 16 with an end face 70 of the first nut 18. The threaded portion of the stud 14 passes through one of apertures 34 in the deflector 16.

The bracket and captured nut assembly 30 are positioned such that the threaded portion of the stud 14 extends through the aperture 46 extending through first land 43. At this time, captured nut 22 is free to axially move toward the first position to allow entry of the stud 14 into the area between first land 43 and second land 44. The distance "X" between the first land 43 and the second land 44 allows for the stud 14 to be completely inserted into the bracket 24 without the nut 22 being engaged with the stud 14. The stud 14 extends into the "C-shape" less than the total distance "X" but far enough to allow for substantial engagement with the captured nut 22. In the embodiment shown, the stud 14 extends more than halfway into the "C-shape" of the bracket 24. Nut 22 is rotated to threadingly engage internally threaded aperture 62 with stud 14. Nut 22 is rotated until a clamping force is exerted between flange 54 and first nut 18 thereby clamping bracket 24 and deflector 16 therebetween.

During clamping, nut 22 is located at the second position shown in FIG. 5. At this position, the flats 56 of the nut 22 extend beyond the second land 44. Accordingly, access is provided for a tool used to fasten or unfasten the nut 22. The tool need not fit within the aperture 47.

Furthermore, the foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims.

What is claimed is:

1. A bracket and nut assembly, comprising:

a bracket having a first end and a second end, said first end including a first substantially planar portion spaced apart from and positioned substantially parallel to a second substantially planar portion, a third portion interconnecting said first and second portions, said first portion having a first aperture extending therethrough, said second portion having a second aperture extending therethrough, said first and second apertures being axially aligned with one another; and a nut including a substantially cylindrical hollow body having a plurality of flats, a first end and a second end, wherein a flange radially extends from said first end, said flange being captured between said first portion and said second portion of said bracket, said nut being operable to translate and rotate relative to said bracket.

2. The bracket and nut assembly according to claim 1, wherein said body extends through said second aperture.

3. The bracket and nut assembly according to claim 2, wherein said nut is axially translatable between a first position where said flange contacts said first substantially planar portion and a second position wherein said flange contacts said second substantially planar portion.

4. The bracket and nut assembly according to claim 3, wherein said bracket includes a substantially rectangular cross-section along its length.

5. The bracket and nut assembly according to claim 4, wherein said second aperture has a diameter greater than a diameter of said substantially cylindrical body, but less than an outer diameter of said flange.

6. The bracket and nut assembly according to claim 1, wherein said substantially cylindrical hollow body of said nut has an axial length greater than a spacing between said first substantially planar portion and said second substantially planar portion.

7. The bracket and nut assembly according to claim 6, wherein said nut includes an internal thread extending through the entire length of said nut.

8. The bracket and nut assembly according to claim 1, wherein said nut has an axial length and is operable to axially translate a distance at least one half of said axial length.

9. An internal combustion engine, comprising:

an engine block;

a stud protruding from said engine block;

a bracket having a turned end with a distal portion spaced apart from and positioned substantially parallel to an intermediate portion, said bracket including a first aperture extending through said distal portion and a second aperture extending through said intermediate portion, said apertures being coaxially aligned with one another; and a nut threadably engageable with said stud, said nut including a substantially cylindrical hollow body having a plurality of flats, a first end and a second end, a flange radially extends from said first end, wherein said flange is captured between said distal portion and said intermediate portion of said bracket, said nut being operable to translate and rotate relative to said bracket.

10. The engine as claimed in claim 9, wherein said body extends through said second aperture.

11. The engine as claimed in claim 10, wherein said nut is axially translatable between a first position where said flange contacts said distal portion and a second position wherein said flange contacts said intermediate portion.

12. The engine as claimed in claim 9 further including a second nut threadingly engaging said stud, said second nut being positioned between said engine block and said bracket.

13. The engine as claimed in claim 12 further including a deflector positioned between said second nut and said bracket, said nut being operable to provide a clamping force to couple said deflector and said bracket to said engine block.

14. The engine as claimed in claim 13, wherein said bracket includes a substantially rectangular cross-section along its length.

15. The engine as claimed in claim 14, wherein said substantially cylindrical hollow body of said nut has an axial length greater than a spacing between said distal portion and said intermediate portion.

16. The engine as claimed in claim 9, wherein said nut has an axial length and is operable to axially translate a distance at least one half of said axial length.

17. A method of making a bracket and nut assembly, comprising:

forming a first aperture in an end portion of the bracket proximate a distal end;

forming a second aperture in the bracket spaced apart from said first aperture;

positioning a nut having an end with a radially extending flange in the first aperture; and forming the bracket to capture the nut, wherein the first aperture and the second aperture are substantially aligned, the radially extending flange being located therebetween.

18. The method of claim 17 further including forming said end portion into a "C-shape."

19. The method of claim 18 further including forming the bracket to capture the nut such that the nut can axially travel a distance at least one half of its axial length.

20. The method of claim 19 further including forming an opposite end of the bracket to support a tubular member.

* * * * *